US005879520A

United States Patent [19]

Griego

[11] Patent Number: 5,879,520

[45] **Date of Patent: *Mar. 9, 1999**

[54] ROTARY ELECTRODEPOSITION APPARATUS

[76] Inventor: Thomas P. Griego, 608 N. First St., Grants, N. Mex. 87020

[ * ] Notice: The term of this patent shall not extend beyond the expiration date of Pat. No. 5,565,079.

[21] Appl. No.: 729,961

[22] Filed: Oct. 15, 1996

Related U.S. Application Data

[63] Continuation-in-part of Ser. No. 445,728, May 22, 1995, Pat. No. 5,565,079, which is a continuation-in-part of Ser. No. 295,055, Aug. 26, 1994, Pat. No. 5,487,824.

[51] Int. Cl.[6] ..... C25D 17/00

[52] U.S. Cl. ..... 204/212; 204/275

[58] Field of Search ..... 204/199–201, 204/212, 275, 280

[56] References Cited

U.S. PATENT DOCUMENTS

| | | | |
|---|---|---|---|
| 2,016,455 | 10/1935 | Merkenschlager | 209/556 |
| 2,085,711 | 6/1937 | Biesmann | 209/179 |
| 3,061,536 | 10/1962 | Gruber | 204/250 |
| 3,196,095 | 7/1965 | Wadsworth | 204/212 X |
| 3,359,195 | 12/1967 | Hojyo | 204/212 |
| 3,425,926 | 2/1969 | Hoiyo | 204/213 |
| 3,591,466 | 7/1971 | Heiman | 205/114 |
| 3,647,669 | 3/1972 | Kelso | 204/212 |
| 3,716,461 | 2/1973 | Ahmad | 205/114 |
| 3,763,001 | 10/1973 | Withers | 205/73 |
| 3,783,110 | 1/1974 | Ahmad | 205/76 |
| 4,305,792 | 12/1981 | Kedward et al. | 205/109 |
| 5,472,592 | 12/1995 | Lowery | 202/212 X |
| 5,487,824 | 1/1996 | Griego . | |

FOREIGN PATENT DOCUMENTS

| | | | |
|---|---|---|---|
| 612106 | 4/1935 | Germany | 48/12 |

OTHER PUBLICATIONS

Ishikawa, H. et al., "Microencapsulation and Compation of Hydrogen Storage Alloy," *Zeitschrift fur Physikalische Chemie Neue Folge,* 164, pp. 1409–1414 (1989) (No Month).

Ishikawa, H., et al., "Preparation and Properties of Hydrogen Storage Alloys Microencapsulated by Copper," *Journal of the Less–Common Metals,* vol. 120, pp. 123–133 (1986) (No Month).

Ishikawa, H., et al., "Preparation and Properties of Hydrogen Storage Allow–Copper Microcapsules," *Journal of the Less–Common Metals,* vol. 107, pp. 105–110 (1985) (No Month).

Naito, K., et al., "Factors Affecting the Characteristics of the Negative Electrodes for Nickel–Hydrogen Batteries," *Journal of Applied Electrochemistry,* vol. 23, pp. 1051–1055 (1993) (No Month).

Naito, K., et al., "Electrochemical Characteristics of Hydrogen Storage Alloys Modified by Electrless Nickel Coatings," *Journal of Applied Electrochemistry,* vol. 24, pp. 808–813 (1994) No Month.

Sakai, T., et al., "Nickel–Metal Hydride Battery Using Microencapsulated Alloys,"*Journal of the Less–Common Metals,* vol. 172 (174), pp. 1194–1204 (1991).

*Primary Examiner*—Donald R. Valentine
*Attorney, Agent, or Firm*—Jeffrey D. Myers

[57] ABSTRACT

An improved apparatus for electrodeposition of materials by centrifugal means. Improvements include provision of multiple return drains, multiple input nozzles, sloped cathode contacts, slotted solution control rings rather than microporous membranes, and automatic unloading of finished product.

20 Claims, 6 Drawing Sheets

ROTARY ELECTRODEPOSITION APPARATUS

CROSS-REFERENCE TO RELATED APPLICATIONS

This application is a continuation-in-part of applications Ser. No. 08/445,728 filed on May 22, 1995 issuing as U.S. Pat. No. 5,565,079 on Oct. 15, 1996; and Ser. No. 08/295,055 filed on Aug. 26, 1994 now U.S. Pat. No. 5,487,824.

BACKGROUND OF THE INVENTION

1. Field of the Invention (Technical Field)

The present invention relates to apparatuses and methods for electroplating and electroforming, particularly by centrifugal means. The term "electrodeposition" as used throughout the specification and claims means electroplating and/or electroforming.

2. Background Art

The prior art is described in U.S. Pat. No. 5,487,824 and No. 5,565,079, which have been incorporated by reference, above.

SUMMARY OF THE INVENTION (DISCLOSURE OF THE INVENTION)

The present invention is of an improvement to a rotary flow-through electrodeposition apparatus comprising an electrodeposition solution return basin, comprising: a plurality of solution return drains disposable beneath the solution return basin; and a device for switching the solution return basin's position among positions above each of the solution return drains. In the preferred embodiment, the improvement includes a plurality of solution reservoirs, each connected to one or more of the solution return drains. The switching device is preferably rotary and the return drains disposed on an arc traversed by the device.

The present invention is also of an improvement to a rotary flow-through electrodeposition apparatus comprising an anode immersion unit, comprising: a plurality of solution feed nozzles; and an engagement device for switching one of the feed nozzles to provide solution to the anode immersion unit. In the preferred embodiment, the engagement device is rotary.

The invention is additionally of a rotary flow-through electrodeposition apparatus comprising: an anode immersion unit; a plurality of solution feed nozzles; an engagement device for switching one of the feed nozzles to provide solution to the anode immersion unit; a rotary electrolytic cell in which the anode immersion unit is immersed; an electrodeposition solution return basin beneath the rotary electrolytic cell; a plurality of solution return drains disposable beneath the solution return basin; and a device for switching the solution return basin's position among positions above each of the solution return drains. In the preferred embodiment, the engagement device and switching device are rotary (the switching device preferably traversing an arc on which the solution return drains are disposed) and the apparatus includes a plurality of solution reservoirs, each connected to one or more of the solution return drains.

The present invention is further of an improvement to a rotary flow-through electrodeposition apparatus having an annular cathode contact ring, comprising an interior surface of the annular cathode contact ring sloped such that a top of the annular cathode contact ring has a diameter larger than a diameter of a bottom of the annular cathode contact ring. In the preferred embodiment, the diameter to height aspect ratio of the annular cathode contact ring is approximately 2:1 or less.

The present invention is also of an improvement to a rotary flow-through electrodeposition apparatus comprising annular solution return means, comprising annular solution return means comprising precision-cut orifices therein. In the preferred embodiment, the orifices are slots and are cut by laser.

The present invention is further of a rotary flow-through electrodeposition apparatus comprising an annular cathode contact ring and a floor plate, comprising: a floor plate moveable downwardly from the annular cathode contact ring to an open position; and flushing means causing work product to be flushed from the apparatus through an opening between the floor plate and the annular cathode contact ring when the floor plate is in the open position. In the preferred embodiment, the floor plate is moveable pneumatically. A sloped bottom drain basin is provided into which the work product is flushed, from which a vibrator may deliver the work product.

A primary object of the apparatus of the present invention is to permit a multi-step electroplating process without physical transfer of the plating fixture or cumbersome manual exchange of solutions, and to permit automatic removal of the plated materials.

Another advantage of the apparatus of the present invention is that materials can be plated many times faster than with existing technology.

An additional advantage of the apparatus of the present invention is that only the inside of the cell is wetted by chemistry and all solutions are exchanged using high speed rotation for removal.

Another advantage of the apparatus of the invention is that it can be used in both anodic and cathodic modes: anodic for electrocleaning, electropolishing, anodizing powder materials, and electrodialysis; cathodic for electrodeposition.

A primary advantage of the processes of the invention is that a wide-range of useful articles may be made thereby, including but not limited to misch metal powder composite in nickel mesh, platinum plated powder mesh, bonded diamond or other abrasive, engineered composite film for wear surface guides or bearings, dielectric films, non-leachable and chemically inert film composite of radioactive isotope particles, composite films for sensor devices or fuses, electroformed sintered type membranes, composite strips bearing blended microencapsulated reactive materials with critical stoichiometry for weapons detonation devices, composite alloy films with post thermo-formable engineering polymer resins, and high conductive heating elements.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS (BEST MODES FOR CARRYING OUT THE INVENTION)

The present invention utilizes centrifugal force to compact bulk materials in solution (preferably aqueous) against an electrolytic cathode contact. The particle material is loaded through the top opening and the plating cell is rotated at sufficiently high rpm to centrifugally cast the powder against the cathode contact. Electroplating solution is then introduced at the top opening of the rotating cell and flows through the cell exiting through a sintered porous plastic ring, laser cut slots, or the like, layered between the domed top, cathode contact ring, and base plate. Electroplating is carried out with a cycle of periodic stopping and/or counter rotation and sequential switching of the DC power supply to the cell to circulate the particle position for even coverage and prevention of agglomeration (bridging).

The present invention comprises improvements to the basic cell technologies disclosed in U.S. Pat. No. 5,487,824 and No. 5,565,079. The invention incorporates multiple return drains, multiple feed nozzles, use of slots rather than porous membranes at the periphery, automated unloading of the cell, and certain means for optimizing production and increasing the work load volume.

Figure 1:
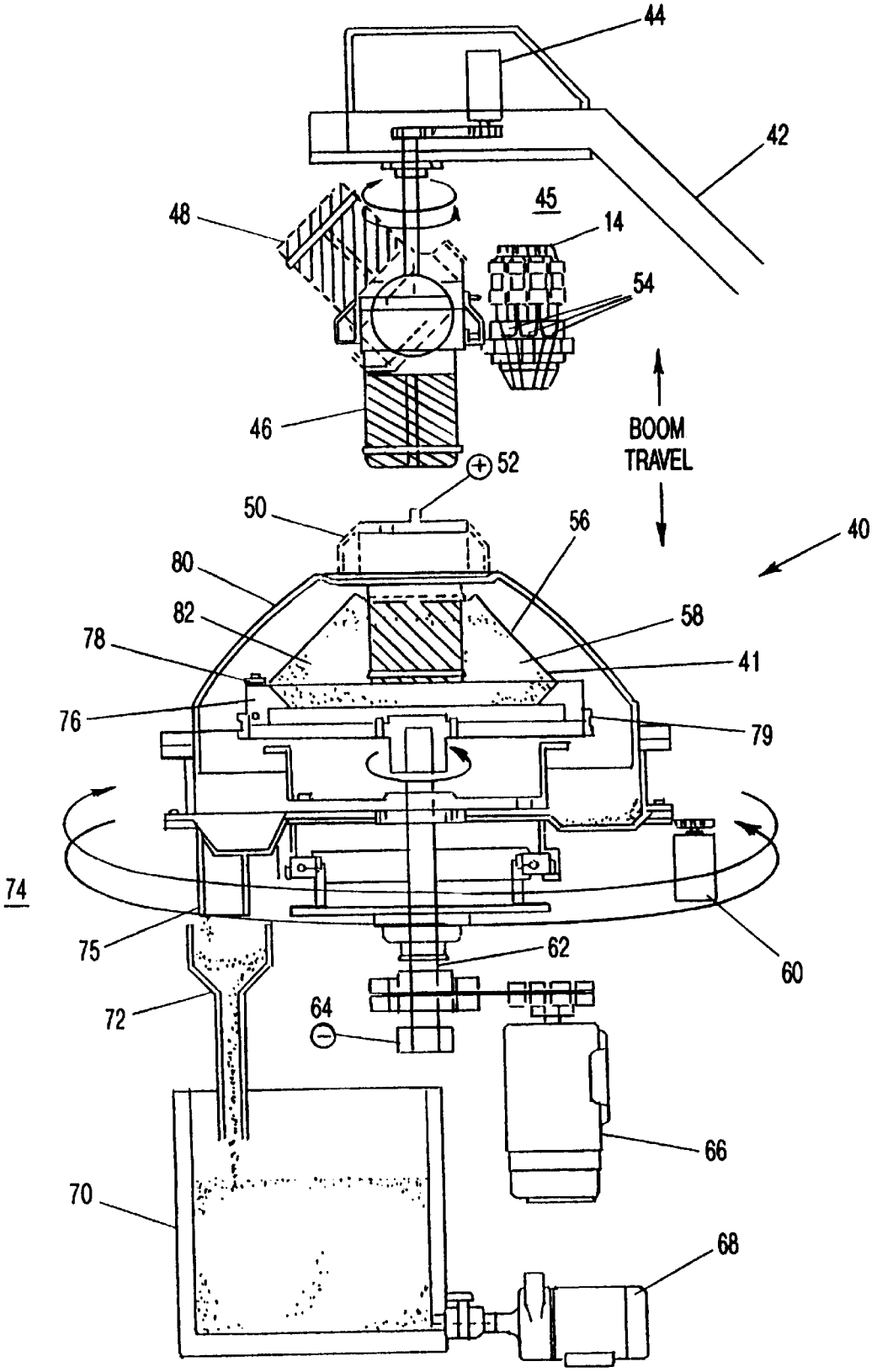
FIG. 1 is a cutaway view of the preferred apparatus of the invention.
Figure 2:
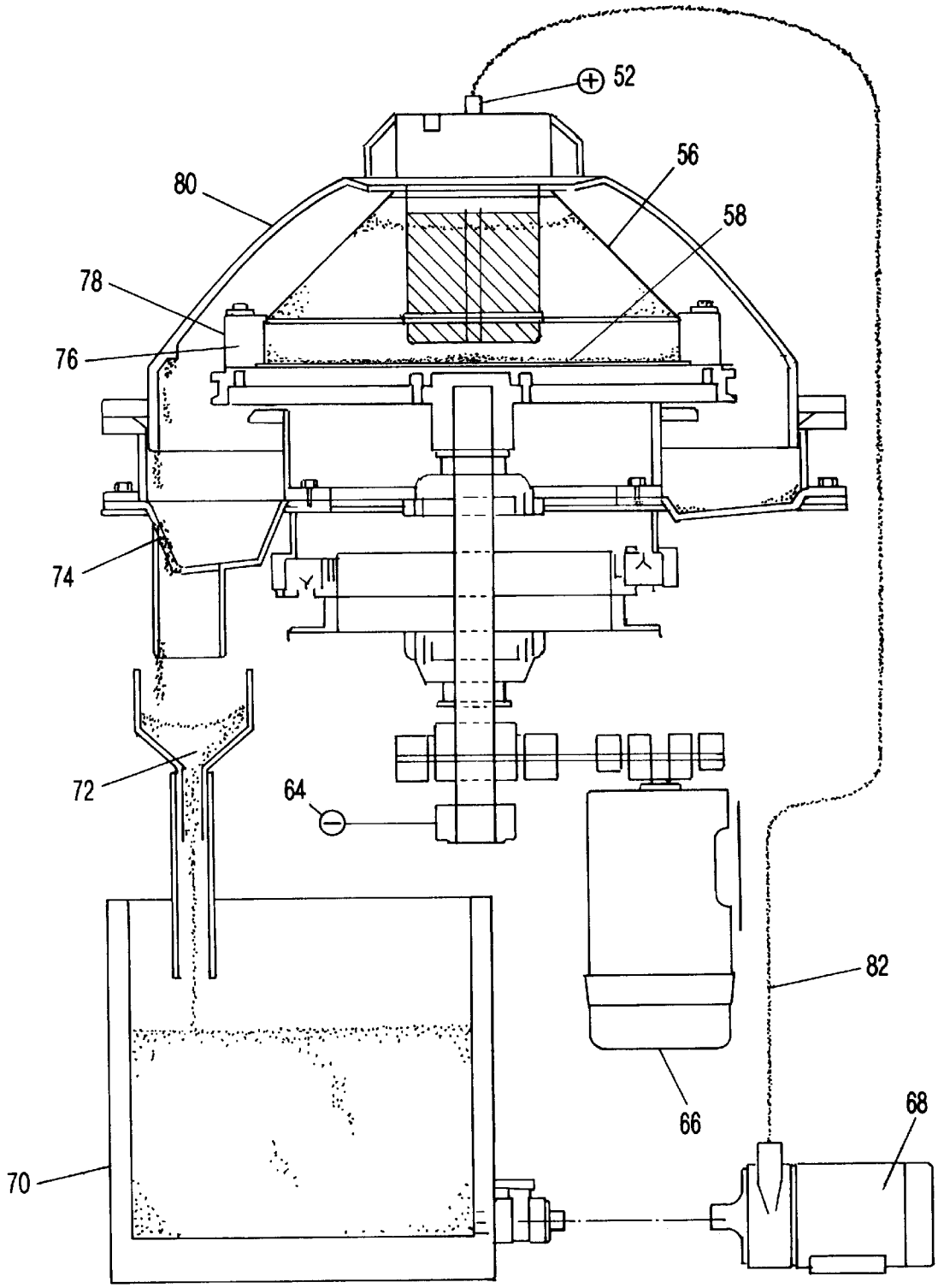
FIG. 2 is a cutaway view of the preferred apparatus of the invention (absent boom and feed nozzles) prior to rotation.
Figure 3:
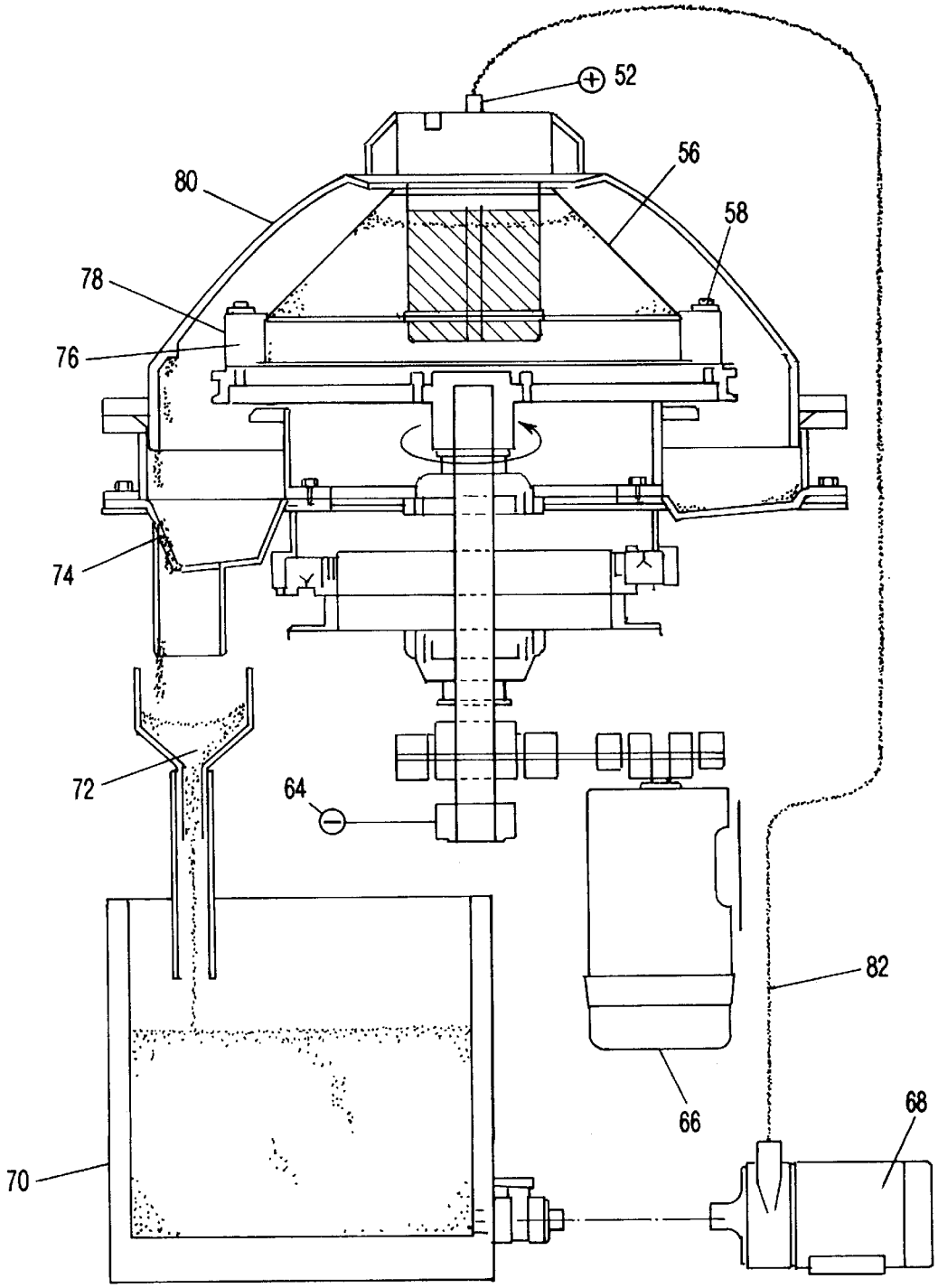
FIG. 3 is a cutaway view of the preferred apparatus of the invention (absent boom and feed nozzles) during rotation.

Turning to FIGS. 1–3, the preferred rotary flow-through plating apparatus (cell) of the present invention 40 comprises a truncated conical drum 41, vertically mounted on a rotating shaft 62 capable of high rotation speed driven by drive motor 66. The cell is operated within a concentric rotating basin 74 that can align a drain port 75 via drive motor 60 over multiple return drains 72 distributed at the radius of the cell which return electrodeposition solution 82 to one of multiple solution reservoirs 70. The electrodeposition solution 82 is then recirculated to the cell by circulation pump 68 and recirculation line 82 (preferably plastic tubing). The drum 41 comprises an open ended dome 56, an cathode contact annular ring 76 (preferably titanium), a porous annular ring 78 (preferably sintered plastic), and a circular base plate 79. The cell also preferably includes a rotating accessory head 45 with multiple feed nozzles 54 providing solution to anode 46 (in position for immersion) and 48 (swung up for clearance) to allow sequential chemical process steps to be carried out in the same cell without elaborate non-automated bypass switching of materials and equipment in mid-process. Rotating accessory head 45 is moved up and down from boom 42 by drive motor 44. When lowered into operating position 50, the anode acts as positive terminal 52 for the electrolytic process performed in the cell together with negative terminal 64. Canopy 80 provides protection to the ambient environment from process-related fumes, and contains process solutions during operations. Optionally, anode and cathode can be switched to operate the apparatus in anodic rather than cathodic mode.

FIG. 2 illustrates material to be plated 58 prior to rotation distributed over circular base plate 79. FIG. 3 shows material 58 during rotation compacted against cathode contact ring 76.

The sequential positioning of the nozzles, anodes (the anode can be easily removed and switched to provide for deposition of different metals), and drain port provides a method to expose the materials being plated to a multiple step chemical process without intermixing the chemistry. Furthermore, the continuous immersion of the plated work prevents oxidation that normally occurs on the substrate when transferred from tank to tank in the conventional barrel plating process. The continuous immersion is preferably achieved by performing all steps of the process in the same cell. The chemical solutions are sequentially returned via the porous ring to the appropriate return drain for a discrete circulation of each chemical solution. Then by introducing the rinse water during high speed rotation the chemical solutions are exchanged with minimal dilution due to the differing specific weights. Subsequent steps are then carried out in the same manner until the plating film is deposited.

Figure 4:
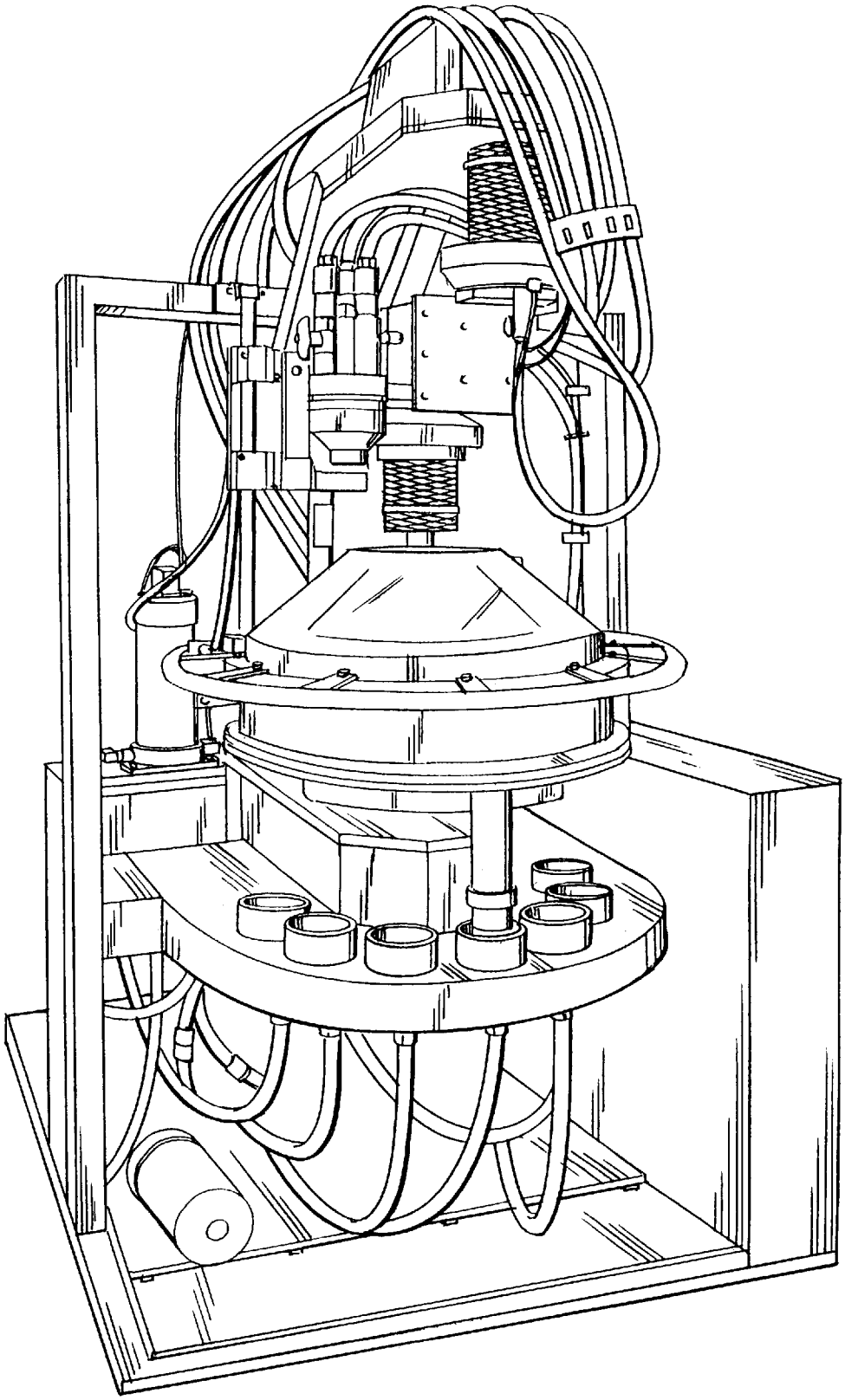
FIG. 4 is a perspective view of the preferred apparatus of the invention.

The preferred cell shown in perspective view in FIG. 4 has significant advantages over preexisting apparatuses for electroplating. The cell preferably has a stainless steel frame, a seamless thermoformed cell and canopy, user programmable logic control with touch screen interface (not shown), AC inverter control drive and pumps, precision linear guides, robotic actuators, redundant safety interlocks, full shielding for safety, full automation or manual control, and a break-away control panel (not shown) for multiple unit modular configuration. Utilizing two anodes (soluble or insoluble for dual metal depositions), four chemistry reservoir tanks, seven solution return drains, and three feed nozzles (although effectively any number of these components is possible), the cell provides for up to 16 sequential process steps. The process is enclosed for effective fume control, has high volume solution flow through for high speed plating, and has a large cathode contact area. A cell having a 42"×78" footprint has the capacity to process approximately 1 liter of material having particle sizes from 5 microns to 5 mm with 100% cathode efficiency, provides plating speeds approximately five times faster than horizontal barrel apparatuses due to the high current settings permitted by the hydrodynamics of the cell and the rotating cathode, and can use as little as 250 ml of rinsing solution per rinse cycle.

For any given cell, an optimum volumetric loading can be established by experiment. The "optimum bed layer thickness", the bed layer being defined as the position of the bulk load of work as it is under rotation and centrifugally compacted against the face of the cathode ring, can be determined as follows: Stop rotation of the loaded cell after continuous rotation with wetted material such that the material will maintain its position due to the surface tension of the liquid. This gives the observer the chance to see the parts in situ by scraping a section of material away to determine thickness. Depending on the type of material that is being coated, there will be a repeatable optimum load that determines the bed layer thickness. If the cathode ring's diameter and face height are held constant and the load volume is increased above the optimum, then there will be a detrimental effect on uniformity of the thickness of the coated deposits.

One method of increasing the optimum load volume is to increase the inner diameter of the cathode ring. This, however, has practical design limits due to the increased mechanical moment that results in instability and excess vibration of the mechanism during rotation. Furthermore, there is a significant loss in performance of the fluid dynamics that are slowed by the proportionately larger cell liquid volume. Finally, the higher G-force present in the enlarged diameter may have detrimental effects on sensitive materials due to the increased dynamic travel during the cell start/stop cycle. The larger diameter and liquid volumes will slow the change of solution in a multiple chemistry process, as well.

The present invention provides a solution to the limitations on work load volume known heretofore. Work load volume may be increased, without sacrificing uniformity of the deposit but maintaining the operating efficiency of the cell, by increasing the face height of the cathode ring. Maintenance of bed layer thickness uniformity over the face of the cathode ring requires higher forces to evenly distribute the material, which can have a detrimental effect on sensitive materials. To enhance even distribution of the material as the cathode increases in height, the present invention provides a ramped inner face 202 that allows the plated material to climb the cathode even with low speed rotation as in FIGS. 5–6. This provides a means to control the cell speed with great latitude while increasing cathode height. Furthermore, the cathode ring diameter to height aspect ratio can be as high as 2:1, depending on the material and the target performance of the application. By limiting the aspect ratio to approximately 2:1, the mechanism will have a controlled moment that will allow the same performance as in a smaller cell. The optimum slope of the ramp is preferably determined by experiment, and will vary depending on the mass of the material being plated, the density of the material, the target volume of the material, and the height of the cathode. If the slope is too radical, the material will nest into a vortex formed by the geometry, resulting in a V-shape layer of material. The bed layer is preferably parallel to the surface of the inside diameter of the cathode (cylindrical plane). The ramp face of the cathode also contributes to better flow-through of the plating solution; the exit for the solution is preferably at the outermost diameter of the cell.

Figure 5:
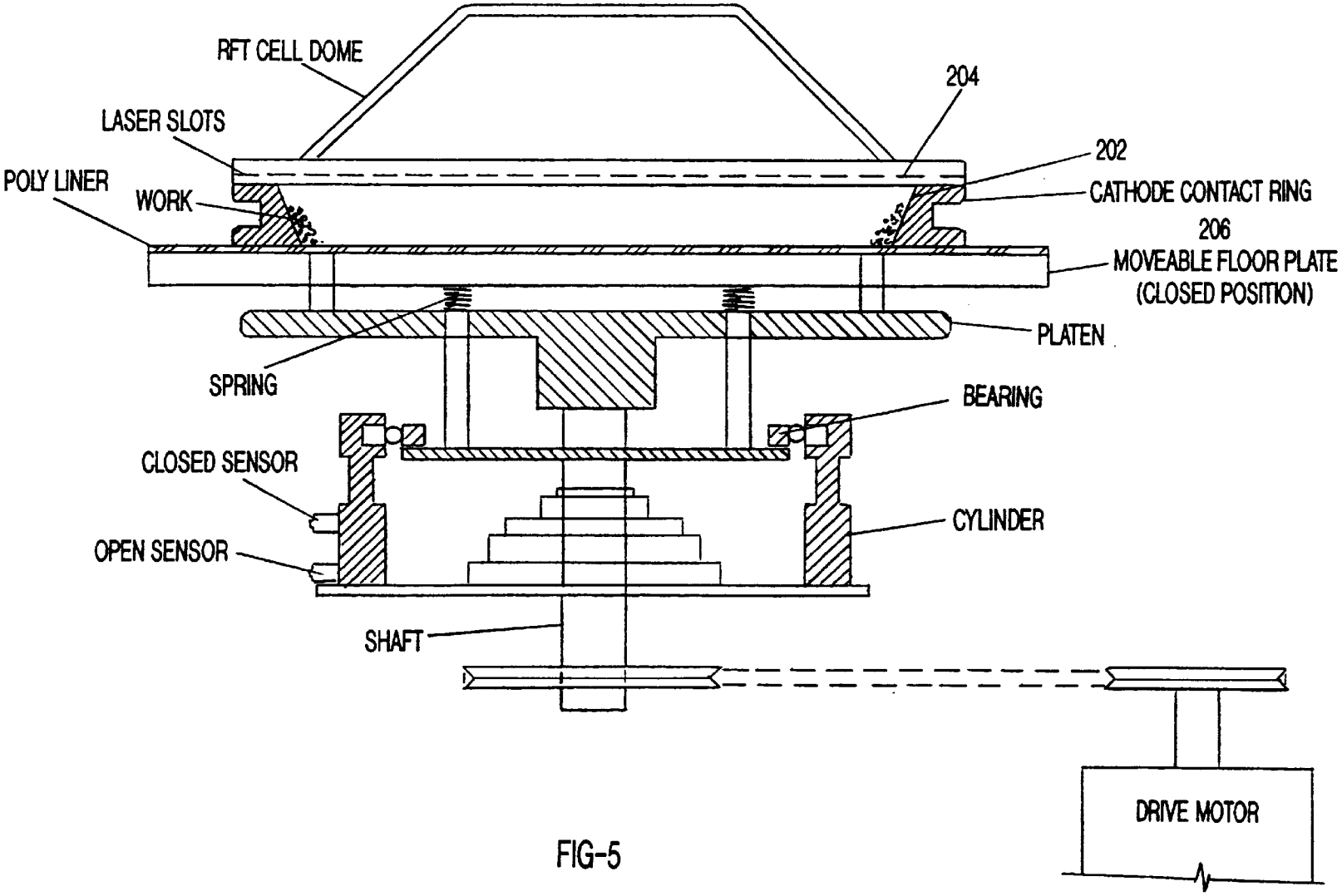
FIG. 5 is a cutaway view of the apparatus of the invention incorporating laser slotting, a ramped cathode face, and a moveable floor plate (closed position)
Figure 6:
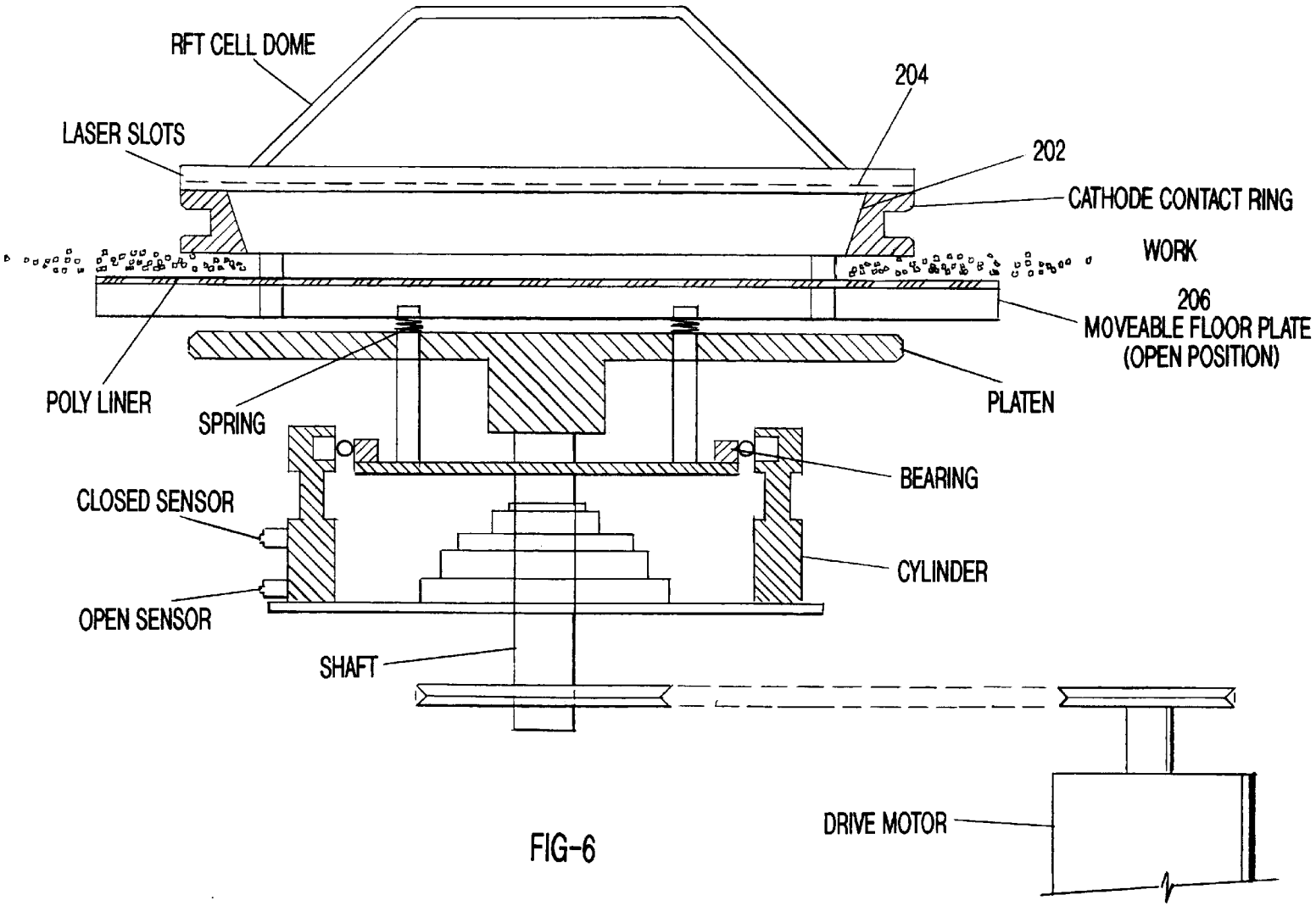
FIG. 6 is a cutaway view of the apparatus of the invention incorporating laser slotting, a ramped cathode face, and a moveable floor plate (open position).

The preferred embodiment depicted in FIGS. 1–3 employs a micro-porous membrane ring that allows the cell to retain micron sized particles while allowing the solution to flow through. Where larger particles are being processed, the micro-porous membrane may be replaced by simple openings 204, preferably laser cut orifices (such as slots) sized appropriately smaller than the particles being processed, as shown in FIGS. 5–6. This provides for better solution exchange with no residual chemistry left behind, as occurs with a micro-porous membrane. This also simplifies the cell mechanism and improves overall maintainability and reliability.

The present invention also provides a mechanism to automatically open a gap in the cell between the cathode and the base plate, allowing for plated materials to be centrifugally discharged to the drain basin, as shown in FIGS. 5–6. This is preferably accomplished by pneumatically actuated base plate 206 that is lowered to reveal a gap between the cathode ring and the base plate. The cell is then rotated with the gap open, and water is flooded into the cell. The discharged plated material is collected in the sloped bottom drain basin and, with the assistance of a mechanical vibrator attached to the pan, all the material is conveyed to the drain nozzle for delivery to a basket/receptacle or for external conveyance to the next operation in a manufacturing process.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. In a rotary flow-through electrodeposition apparatus comprising an electrodeposition solution return basin, an improvement comprising:

a plurality of solution return drains disposable beneath the solution return basin; and means for switching the solution return basin's position among positions above each of said solution return drains.

2. The improvement of claim 1 additionally comprising a plurality of solution reservoirs, each connected to one or more of said solution return drains.

3. The improvement of claim 1 wherein said means for switching comprises rotary means for switching the solution return basin's position.

4. The improvement of claim 3 wherein said solution return drains are disposed on an arc traversed by said rotary means for switching.

5. In a rotary flow-through electrodeposition apparatus comprising an anode immersion unit, an improvement comprising:

a plurality of solution feed nozzles; and means for switchably engaging one of said feed nozzles to provide solution to the anode immersion unit.

6. The improvement of claim 5 wherein said means for switchably engaging comprise rotary means for switchably engaging one of said feed nozzles.

7. A rotary flow-through electrodeposition apparatus comprising:

an anode immersion unit;

a plurality of solution feed nozzles;

means for switchably engaging one of said feed nozzles to provide solution to said anode immersion unit;

a rotary electrolytic cell in which said anode immersion unit is immersed;

an electrodeposition solution return basin beneath said rotary electrolytic cell;

a plurality of solution return drains disposable beneath said solution return basin; and means for switching the solution return basin's position among positions above each of said solution return drains.

8. The apparatus of claim 7 wherein said means for switchably engaging comprise rotary means for switchably engaging one of said feed nozzles.

9. The apparatus of claim 7 additionally comprising a plurality of solution reservoirs, each connected to one or more of said solution return drains.

10. The apparatus of claim 7 wherein said means for switching comprises rotary means for switching said solution return basin's position.

11. The apparatus of claim 10 wherein said solution return drains are disposed on an arc traversed by said rotary means for switching.

12. In a rotary flow-through electrodeposition apparatus comprising an annular cathode contact ring, an improvement comprising an interior surface of the annular cathode contact ring sloped such that a top of the annular cathode contact ring has a diameter larger than a diameter of a bottom of the annular cathode contact ring.

13. The improvement of claim 12 wherein a diameter to height aspect ratio of the annular cathode contact ring is equal to or less than approximately 2:1.

14. In a rotary flow-through electrodeposition apparatus comprising annular solution return means, an improvement comprising annular solution return means comprising precision-cut orifices therein.

15. The improvement of claim 14 wherein said orifices comprise slots.

16. The improvement of claim 14 wherein said precision-cut orifices are cut by laser.

17. In a rotary flow-through electrodeposition apparatus comprising an annular cathode contact ring and a base plate, an improvement comprising:

means for moving the base plate downwardly from the annular cathode contact ring to an open position; and means for flushing work product from the apparatus through an opening between the base plate and the annular cathode contact ring when the base plate is in said open position.

18. The improvement of claim 17 wherein said means for moving the base plate comprises pneumatic means.

19. The improvement of claim 17 additionally comprising a sloped bottom drain basin into which the work product is flushed.

20. The improvement of claim 19 additionally comprising vibrator means attached to said sloped bottom drain basin.

* * * * *